US010252548B2

(12) United States Patent
Paul et al.

(10) Patent No.: US 10,252,548 B2
(45) **Date of Patent: *Apr. 9, 2019**

(54) METHOD FOR MANUFACTURING PRINTED PRODUCTS

(71) Applicant: HEIDELBERGER DRUCKMASCHINEN AG, Heidelberg (DE)

(72) Inventors: Thomas Paul, Heidelberg (DE); Peter Hachmann, Weinheim-Hohensachsen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/604,912

(22) Filed: May 25, 2017

(65) Prior Publication Data

US 2017/0341418 A1 Nov. 30, 2017

(30) Foreign Application Priority Data

May 25, 2016 (DE) ..... 10 2016 209 079

(51) Int. Cl.
*B41J 11/00* (2006.01)
*B41M 5/52* (2006.01)
*B41M 7/00* (2006.01)

(52) U.S. Cl.
CPC ..... *B41J 11/002* (2013.01); *B41M 5/52* (2013.01); *B41M 5/5218* (2013.01); *B41M 5/5227* (2013.01); *B41M 7/00* (2013.01); *B41M 7/0018* (2013.01)

(58) Field of Classification Search
CPC ..... C09D 11/36; C09D 11/40; C09D 11/30; C09D 11/38; C09D 11/322; C09D 11/328;
(Continued)

(56) References Cited

U.S. PATENT DOCUMENTS 8,628,184 B2 * 1/2014 Aoyama ..... B41J 11/002 347/100
8,721,062 B2 * 5/2014 Sano ..... B41J 3/407 347/100
(Continued)

FOREIGN PATENT DOCUMENTS

DE 102010060409 A1 5/2012
WO 2014173763 A1 10/2014

*Primary Examiner* — Manish S Shah
(74) *Attorney, Agent, or Firm* — Laurence A. Greenberg; Werner A. Stemer; Ralph E. Locher

(57) ABSTRACT

A method for manufacturing printed products contains the steps of applying at least one colored and water-containing ink to image regions on a printing material in a drop-on-demand process. An essentially colorless and water-containing liquid is applied a) to non-image regions and/or b) to image regions that have only little ink in the drop-on-demand process. The printing material is dried. The printing material has a coating that contains at least one acid. After the application of ink and the application of a liquid, a water-containing further liquid, for instance a varnish, is applied both to image regions and to non-image regions of the printing material, and that the liquid and/or the further liquid contains at least one substance that at least partly neutralizes the acid. The undesired formation of waves and glossiness fluctuations between varnished image regions and varnished non-image regions may thus advantageously be avoided.

16 Claims, 1 Drawing Sheet

(58) Field of Classification Search
CPC ..... C09D 11/101; C09D 11/005; C09D 11/54; C09D 11/52; B41J 2/01; B41J 2/211; B41J 2/1433; B41J 2/17; B41J 2/17593; B41J 2/2107; B41J 2/1755; B41J 2/2114; B41J 2/2117; B41J 11/0015; B41J 11/002; B41J 2/2056; B41J 2/21; B41J 2/0057; B41J 3/60; B41J 2002/012; B41J 2/04598; B41J 2/04588; B41J 2/04595; B41J 2/04586; B41J 2/14274; B41M 5/0011; B41M 5/0017; B41M 7/00; B41M 7/0072; B41M 5/52; B41M 5/5218
See application file for complete search history.

(56) References Cited

U.S. PATENT DOCUMENTS

2001/0020964 A1* 9/2001 Irihara ..... B41J 2/2114 347/43
2002/0077386 A1* 6/2002 Kurabayashi ..... B41M 5/0017 523/161
2004/0104986 A1* 6/2004 Nito ..... B41J 2/2107 347/96
2005/0243121 A1* 11/2005 Onishi ..... B41J 2/2114 347/21
2010/0053236 A1 3/2010 Ooishi et al.
2012/0113205 A1 5/2012 Link
2012/0249668 A1* 10/2012 Denda ..... B41J 2/2107 347/20
2013/0286069 A1* 10/2013 Aoyama ..... B41J 2/2117 347/9
2016/0251532 A1 9/2016 Yano et al.

* cited by examiner

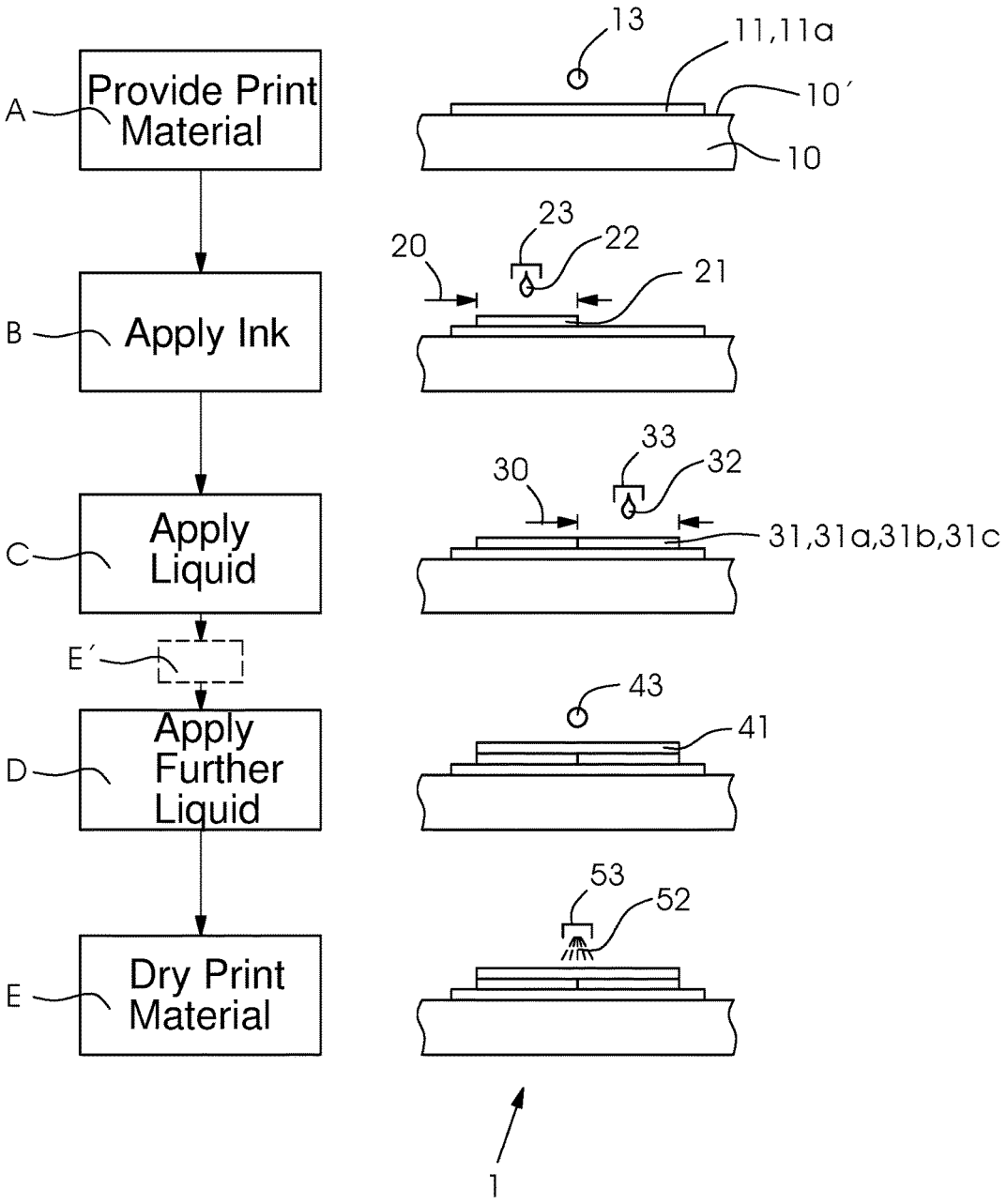
A
Provide Print Material
B
Apply Ink
C
Apply Liquid
E´
D
Apply Further Liquid
E
Dry Print Material
13
11,11a
10´
10
23
22
20
21
33
32
30
31,31a,31b,31c
43
41
53
52
1

METHOD FOR MANUFACTURING PRINTED PRODUCTS

CROSS-REFERENCE TO RELATED APPLICATION

This application claims the priority, under 35 U.S.C. § 119, of German application DE 10 2016 209 079.8, filed May 25, 2016; the prior application is herewith incorporated by reference in its entirety.

THE NAMES OF THE PARTIES TO A JOINT RESEARCH AGREEMENT

This invention was made pursuant to a joint research agreement between Heidelberger Druckmaschinen AG and Fujifilm Corporation.

BACKGROUND OF THE INVENTION

Field of the Invention

The present invention relates to a method for manufacturing printed products.

The technical field of the invention is the graphic arts industry, in particular the field of inkjet printing. In the known drop-on-demand (DoD) inkjet printing methods, a print head creates tiny ink droplets in accordance with the image to be printed and transfers these droplets onto a printing material without contact to create the printed image on the printing material. The printing material may be a sheet or web of paper, cardboard, or plastic.

Published, non-prosecuted German patent application DE 10 2010 060 409 A1, corresponding to U.S. patent publication No. 20120113205, discloses a method for reducing the formation of waves in a printing material in a printer and a corresponding device for printing on a printing material. In the disclosed process, ink is applied to at least one printing region on the printing material and the moisture of the printing material is increased in at least one non-printed part of the printing material. This may be done by applying a transparent liquid. Thus in image regions, ink may be applied, and in non-image regions, a transparent liquid may be applied. A separate print head may be provided to apply the transparent liquid.

This prior art document presents a solution to the known problem that printing materials exhibit an undesirable formation of waves when uneven amounts of moisture are applied. An additional problem is, however, that printed products that are varnished after the printing process may have an uneven gloss: although the varnish is applied evenly, unprinted regions may be less glossy than printed regions.

U.S. patent disclosure No. 2010/0053236 A1 discloses an ink printing method wherein a pre-coat containing an acid is initially applied to a substrate. Subsequently, a water-based ink is applied, whose droplets aggregate due to the acid and thus spread only to a limited extent. The ink print is subsequently dried.

In experiments on varnishing such ink prints that have been aggregated by an acid, it has been found that the aforementioned problem of an uneven gloss may occur and may have a considerable detrimental effect. Attempts have been made to solve this problem; the result is the invention described below.

SUMMARY OF THE INVENTION

Against this background, an object of the present invention is to provide a method for manufacturing printed products that is an improvement over the prior art and solves both the problem of wave-forming and the problem of an uneven glossiness. Thus another object of the present invention is to provide a method for creating better printed products than methods of the prior art, i.e. printed products of a more homogeneous glossiness.

In accordance with the invention, a method for manufacturing printed products contains the steps of applying at least one colored and water-containing ink to image regions on a printing material in a drop-on-demand process and applying an essentially colorless and water-containing liquid a) to non-image regions and/or b) to image regions that have little ink in a drop-on-demand process and drying the printing material. The printing material has a coating containing at least one acid, and that, after applying the ink and applying a liquid, a water-containing further liquid is applied both to image regions and to non-image regions of the printing material. The liquid and/or the further liquid contains at least one substance for at least partly neutralizing the acid, the neutralizing substance being a salt of a further acid that is weaker than the acid of the coating; i.e. the weaker acid has a higher acidity constant than the acid in the coating.

Such a method of the invention solves the problems indicated above and advantageously allows printed products to be manufactured that exhibit neither the undesired formation of waves nor undesired uneven glossiness.

An essential feature of the invention is that the liquid and/or the further liquid contains at least one substance that at least partly neutralizes the acid provided in the coating. This prevents the acid from reacting with the further liquid, e.g. a water-based varnish, and modifying the gloss properties thereof. Thus the application of the neutralizing substance preferably occurs in such a way that the neutralizing of the acid eliminates an uneven glossiness on the printing material or reduces it to a value below a defined value.

The neutralizing substance is preferably a substance that increases the pH value of the printing material and/or of the coating, preferably to 5 or a value above 5.

In the context of the invention, the expression "image areas with little ink" are understood to be image areas that have an area coverage below 100%, in particular below 95% or 90% or 75% or 50% of area coverage, i.e. in such areas, the white of the paper shines through.

Advantageous and thus preferred further developments of the invention will become apparent from the dependent claims as well as from the description and the associated drawings.

A preferred further development of the invention may be characterized in that the neutralizing substance is a salt of a carboxylic acid, e.g. a salt of benzoic acid, acetic acid, or citric acid.

A preferred further development of the invention may be characterized in that the neutralizing substance is a salt of carbonic acid, in particular an alkali carbonate, e.g. sodium carbonate.

A preferred further development of the invention may be characterized in that the neutralizing substance is provided in the form of a solution of an acidic polymer, the solution at least partly neutralized, preferably with NaOH or KOH and preferably on the basis of acrylic acid or methacrylic acid, e.g. sodium salt of polyacrylic acid or sodium salt of polymethacrylic acid. The solution is preferably an aqueous solution.

A preferred further development of the invention may be characterized in that the neutralizing substance is provided in the form of a solution of an acidic, preferably polymeric dispersing agent contained in the ink, the solution at least partly neutralized, preferably with NaOH or KOH. The solution is preferably an aqueous solution. Preferably, the dispersing agent of the pigment is used. Joncryl® Polymers of BASF SE, e.g. Joncryl® 678, are a preferred group of such dispersing agents.

A preferred further development of the invention may be characterized in that the liquid is a colorless, water-based ink essentially without binding agent, in particular an unpigmented or colorant-free ink. If a liquid without pigments or colorants is used, the visual impression of the printed product to be manufactured is not altered in any discernible way. An additional advantage of using ink as the liquid is that the liquid may be applied to the printing material without difficulty by an inkjet print head. The ink may contain otherwise common additives such as surfactants, biocides, humectants, or defoaming agents. These additives and their volume in the ink may advantageously be used to adjust the applicability of the ink by means of a conventional print head and/or the ability to sufficiently wet the printing material for a good print result.

Another preferred further development of the invention may be characterized in that the concentration of the neutralizing substance essentially corresponds to a defined concentration value and that the defined concentration value is a function of the concentration of the acid or of the mixture of multiple acids in the coating. The concentration of the neutralizing substance, in particular of the neutralizing acid groups in the neutralizing substance, may preferably be selected to be as high as the concentration of the acid or neutralized acid groups in the coating.

A preferred further development of the invention may be characterized in that the defined concentration value is selected in a way to achieve an essentially complete neutralization of the acid. The concentration of the protons in the coating, which may be calculated from the pH value of the coating, may preferably be selected to be as high as the concentration of the neutralizing substance, in particular the neutralizing acid group in the neutralizing substance, and vice versa.

The amount to be applied may be calculated by adding up the relevant regions of the printing material that are to be coated, i.e. the ones with paper white.

A preferred further development of the invention may be characterized in that the drying effect is achieved by applying IR radiation to the printing material and in that the liquid contains an IR absorber as a second substance. The fact that in accordance with the invention, the water-containing liquid is applied in addition to the water-containing ink increases the amount of water and thus the demands on the drying process. Thus it is advantageous to improve the drying properties of the liquid at the same time. This may advantageously be achieved by the use of an IR absorber. This may advantageously prevent printed products from drying insufficiently and sticking together, for instance in a delivery stack.

A preferred further development of the invention may be characterized in that the liquid contains an optical whitener as a third substance. This measure is advantageous if a decreasing brightness value would otherwise have to be expected at least in the regions to which the liquid is applied due to the application of the acidic coating and/or due to the application of the liquid.

A preferred further development of the invention may be characterized in that in a case a) the average of the amount of liquid applied per unit area calculated for the printing material essentially corresponds to the average of the amount of ink applied per unit area calculated for the printing material. This measure may advantageously achieve that on average, the dampening of the printing material by the water contained in the ink and by the water contained in the liquid is approximately even over the entire treated surface of the printing material. This measure may likewise prevent the undesired formation of waves.

A preferred further development of the invention may be characterized in that the further liquid is colorless, in particular a colorless and water-based varnish.

Other features which are considered as characteristic for the invention are set forth in the appended claims.

Although the invention is illustrated and described herein as embodied in a method for manufacturing printed products, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The single FIGURE of the drawing is a flow chart of a preferred exemplary embodiment of a method of the invention as well as an illustration of device-related measures for implementing the method.

DETAILED DESCRIPTION OF THE INVENTION

Referring now to the single FIGURE of the drawing in detail, there is schematically illustrated steps A to E and E', respectively, of a preferred embodiment of the method of the invention in a flow chart. Next to every step, the FIGURE also schematically shows the respective device-related measures that may be taken and how the printed product may successively be produced.

Step A is to provide a printing material 10 having a surface 10'. The printing material may be a sheet or a web. The printing material may be made of paper, cardboard, or plastic. A coating 11 containing an acid 11*a* is applied to the printing material. The coating may for instance be applied by means of a roller 13. As an alternative to the illustrated step A, it may be envisaged that a printing material that already has an acidic coating is provided.

In step B, a water-based ink 21 is printed onto the printing material 10 or rather the surface 10' thereof, i.e. an ink layer 21 is created. The image region may for instance represent a pattern, image, or text. To create the ink layer 21, ink drops 22 are transferred to the printing material, i.e. the surface thereof, in a contact-free way by means of a print head 23. In this process, the print head is controlled in a known way, making use of the print data required for the image. In general, this process requires a relative movement between the print head and the printing material to be generated. It is possible to apply more than one ink, e.g. four (CMYK) or more than four (CMYK plus spot color/s) inks. The ink may contain pigments or colorants to give it color.

In step C, a liquid 31 is applied to a non-image region 31 and/or a liquid layer 31 is created. The liquid contains at least one substance 31*a* for neutralizing the acid 11*a*. In addition, the liquid may contain a second substance 31*b*, preferably an IR absorber. In addition, the liquid may contain a third substance 31*c*, preferably an optical whitener. In the non-image regions of the surface 10' of the printing material 10, the application of the liquid 31 and the neutralizing substance 31*a* contained therein neutralizes the acid 11*a*. The application of the liquid 31 is achieved by transferring liquid drops 32 to the surface of the printing material in a contact-free way by a further print head 33. The use of a print head makes it easy to control the amount of liquid that is applied.

In step D, a further liquid 41 is applied to the printing material 10, i.e. the surface 10' thereof, and/or a further liquid layer 41 is created. The application may for instance be achieved by a roller 43. The further liquid may be a colorless or transparent water-based varnish. Such a layer of varnish may essentially cover the entire surface of the printing material, i.e. both the image regions 20 and the non-image regions 30. In accordance with the invention, the neutralized acid has no (chemical) effect or only a minor (chemical) effect on the varnish layer, which thus globally (over the entire printing material, i.e. in image regions and non-image regions) exhibits an essentially homogeneous glossiness.

In step E, the printing material 10 or rather the surface 10' thereof and in particular the ink 21 and liquids 31 and 41 applied thereto are dried, preferably thermally. For this purpose, an IR radiation 52 may be generated and directed towards the printing material surface by an IR drier 53, e.g. an LED drier or an LED laser drier. This process may likewise require a relative movement between the drier and the printing material to be carried out. The intensity of the radiation may be controlled.

An alternative to step E is to carry out a drying step E', which preferably occurs after step C and before step D. Another alternative is to carry out both drying steps E and E'.

The following is a summary list of reference numerals and the corresponding structure used in the above description of the invention:

1 printed product
10 printing material
10' surface
11 coating
11*a* acid
13 roller
20 image region
21 ink/ink layer
22 ink drops
23 print head
30 non-image region
31 liquid/liquid layer
31*a* neutralizing substance
31*b* second substance/IR absorber
31*c* third substance/optical whitener
32 drops of liquid
33 further print head
41 further liquids/further liquid layer/varnish layer
43 roller
52 IR radiation
53 IR drier
A providing printing material with coating
B applying ink
C applying liquid
C applying further liquid/varnish
E, E' IR drying

The invention claimed is:

1. A method for manufacturing printed products, which comprises the steps of:

applying at least one colored and water-containing ink to image regions on a printing material in a drop-on-demand process;

applying a generally colorless and water-containing liquid to at least one of a) non-image regions or b) the image regions that have little of said ink in the drop-on-demand process;

drying the printing material, the printing material having a coating containing at least one acid; and applying a water-containing further liquid both to the image regions and to the non-image regions of the printing material after performing the applying of the ink and the applying of the liquid, wherein at least one of the liquid or the further liquid containing at least one neutralizing substance for at least partly neutralizing the acid, the neutralizing substance being a salt of a further acid that is weaker than the acid of the coating.

2. The method according to claim 1, which further comprises using the salt of a carboxylic acid as the neutralizing substance.

3. The method according to claim 1, which further comprises using an alkali carbonate as the neutralizing substance.

4. The method according to claim 1, which further comprises creating the neutralizing substance in a form of a solution of an acidic polymer, the solution being at least partly neutralized.

5. The method according to claim 1, which further comprises providing the neutralizing substance in a form of a solution of an acidic, the solution at least being partly neutralized.

6. The method according to claim 1, wherein the liquid is a colorless and the ink is generally without any binding agent.

7. The method according to claim 1, wherein a concentration of the neutralizing substance corresponds to a defined concentration value and the defined concentration value is in dependence on a concentration of the acid in the coating.

8. The method according to claim 7, which further comprises selecting the defined concentration value in a way to achieve a complete neutralization of the acid.

9. The method according to claim 1, which further comprises performing the drying step by applying infrared (IR) radiation to the printing material and wherein the liquid contains an IR absorber as a second substance.

10. The method according to claim 1, wherein the liquid contains an optical whitener as a third substance.

11. The method according to claim 1, wherein in the case a) an average of an amount of the liquid applied per unit area calculated for the printing material corresponds to an average amount of the ink applied per unit area calculated for the printing material.

12. The method according to claim 1, wherein the further liquid is colorless.

13. The method according to claim 1, which further comprises creating the neutralizing substance in a form of a solution of an acidic polymer on a basis of acrylic aid or methacrylic acid, the solution at least being partly neutralized with NaOH or KOH.

14. The method according to claim 1, which further comprises providing the neutralizing substance in a form of a solution of an acidic being a polymeric dispersing agent contained in the ink, the solution at least partly neutralized with NaOH or KOH.

15. The method according to claim 1, wherein the liquid is a colorless, non-pigmented or colorant-free and the ink is without any binding agent.

16. The method according to claim 1, wherein the further liquid is a colorless and water-based varnish.

* * * * *